United States Patent [19]

Bell et al.

[11] 4,446,593

[45] May 8, 1984

[54] CARPET STEAMING TOOL

[75] Inventors: Dwain C. Bell; Lloyd E. Anderson; Martin L. Anderson, all of Minneapolis, Minn.

[73] Assignee: National Carpet Jobbers, Inc., Minneapolis, Minn.

[21] Appl. No.: 340,243

[22] Filed: Jan. 18, 1982

[51] Int. Cl.[3] ..... B08B 3/00

[52] U.S. Cl. ..... 15/322; 15/402; 15/415 A; 8/149.3

[58] Field of Search ..... 8/149.3, 158; 15/320, 15/321, 322, 402, 415 A

[56] References Cited

U.S. PATENT DOCUMENTS

| | | | |
|---|---|---|---|
| 1,803,693 | 5/1931 | Cutting | 15/320 |
| 2,243,607 | 5/1941 | Rosen et al. | 15/415 A X |
| 3,262,146 | 7/1966 | Hays | 15/321 |
| 3,581,529 | 6/1971 | Mitchell et al. | 68/222 |
| 3,755,850 | 9/1973 | Porter | 15/320 |
| 4,327,459 | 5/1982 | Gilbert | 15/321 |

FOREIGN PATENT DOCUMENTS

| | | | |
|---|---|---|---|
| 977910 | 11/1975 | Canada | 15/415 A |
| 1520761 | 8/1978 | United Kingdom | 15/321 |

*Primary Examiner*—Chris K. Moore

*Attorney, Agent, or Firm*—Orrin M. Haugen; Thomas J. Nikolai; Douglas L. Tschida

[57] ABSTRACT

A carpet steaming tool comprising an elongated plenum having a flat steam dispensing surface and a blade member extending along the tool and projecting transversely beyond the dispensing surface to comb or stir a carpet pile while steam is being dispensed.

7 Claims, 8 Drawing Figures

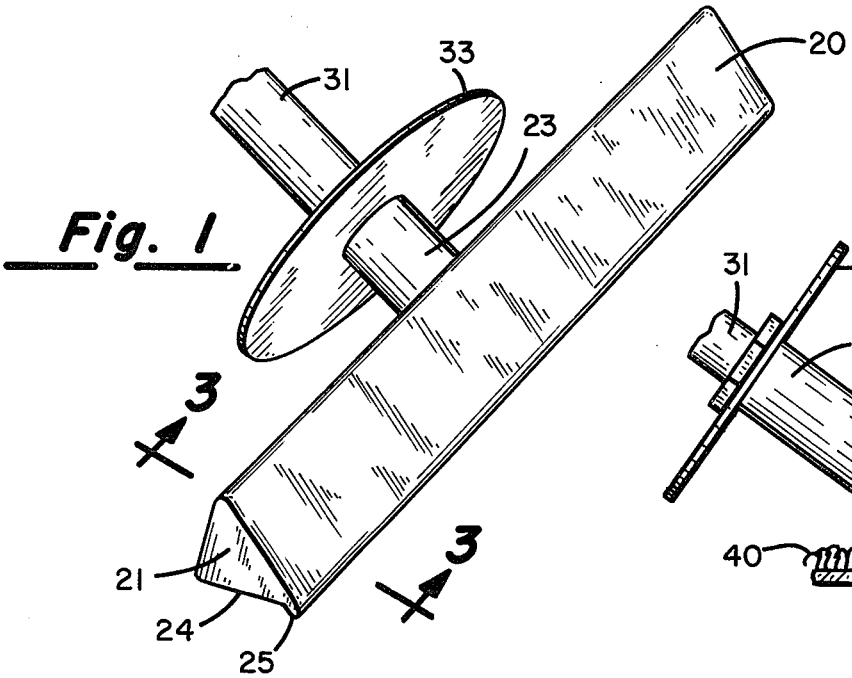
Fig. 1
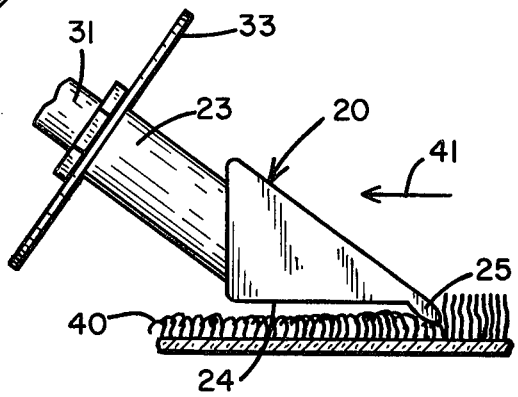
Fig. 2
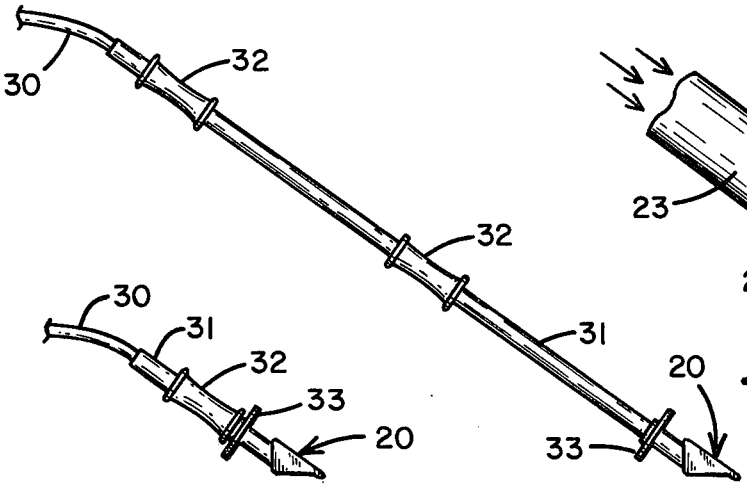
Fig. 4
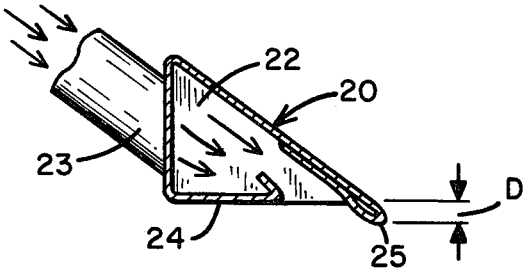
Fig. 3
Fig. 5
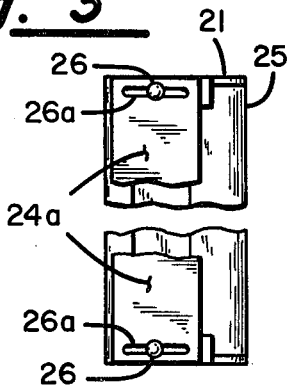
Fig. 8
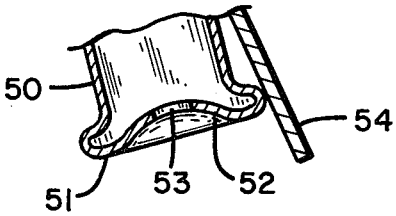
Fig. 7
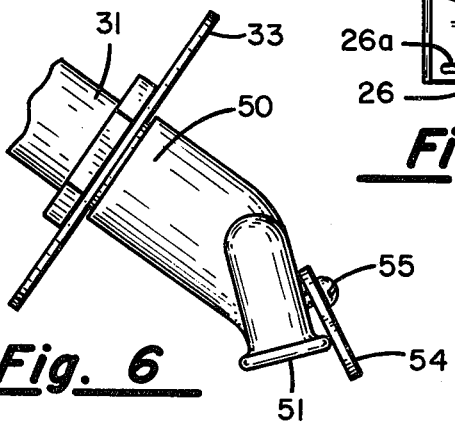
Fig. 6

CARPET STEAMING TOOL

TECHNICAL FIELD

This invention relates to the field of carpet treatment, and particularly to a tool for restoring the appearance of carpet materials of which the pile has become flattened, by long storage in tight rolls for example.

BACKGROUND OF THE INVENTION

It is known by dealers in carpeting that carpet materials when stored under compression, as by shipment in tight rolls or by storage beneath other samples, suffer flattening of the fabric pile, and that simple release of the pressure is not always sufficient to restore the original appearance of the material.

It is also known that the exposing the pile surface to low pressure steam has a desirable effect, restoring the material to its original appearance. Apparatus for this purpose has been developed, and consist of a low pressure steam generator, a flexible hose, and a broad generally flat nozzle, by which the steam is distributed to a wide bank of the material being treated. The flat surface of the nozzle engaging the fabric sometimes acts as an ironer to lay the pile more flat instead of restoring it.

BRIEF SUMMARY OF THE INVENTION

We have found that if the steam dispensing nozzle is equipped with a blade member which not only prevents full flat contact of the nozzle with the material but also acts as a comb to stir the pile while the steam is being applied, the restoration is more complete and takes place more rapidly.

Various advantages and features of novelty which characterize the invention are pointed out with particularity in the claims annexed hereto and forming a part hereof. However, for a better understanding of the invention, its advantages, and objects obtained by it's use, reference should be had to the drawing which forms a further part hereof, and to the accompanying descriptive matter, in which there is illustrated an described a preferred embodiment of the invention.

BRIEF DESCRIPTION OF THE DRAWING

In the drawing, in which like reference numerals indicate corresponding parts throughout the several views, FIG. 1 is a view in perspective of a nozzle according to the invention;

FIG. 2 is a diagrammatic side view of the nozzle in use;

FIG. 3 is a view of the nozzle in section along the line 3—3 of FIG. 1;

FIG. 4 shows the nozzle attached to an elongated manipulating handle;

FIG. 5 shows the nozzle attached to a short manipulating handle;

FIG. 6 is a side view of a second embodiment of the invention;

FIG. 7 is a fragmentary sectional view of the nozzle of FIG. 6; and

FIG. 8 shows an embodiment in which the width of the steam outlet passage may be adjusted.

DESCRIPTION OF THE PREFERRED EMBODIMENTS

FIGS. 1–3 show a first embodiment of the invention to comprise an elongated hollow metal body 20 having closed ends 21 and 22 and a central inlet tap 23 for connection to a source of low pressure steam. Body 20 is formed with a generally flat lower surface 24, below which there projects, by a small distance D, a blade or lip 25 extending across the body. A steam dispensing slot 26 extends across the body between the forward edge of surface 24 and the rear of lip 25.

FIG. 5 shows that the nozzle tap 23 is connected to the flexible conduit 30 of a steam generator, not shown, by a rigid tube or handle 31 having a hand grip 32, and a steam diverting disc 33 for protecting the user's hand. For some applications, a longer handle 31 may be desirable, as shown in FIG. 4, and may include a pair of hand grips 32.

FIG. 2 shows the nozzle in use. It is applied with surface 24 generally parallel to the pile 40 of the fabric being treated, and is moved back and forth in the direction of arrow 41. Steam is dispensed through slot 26 to the fabric, and lip 25 prevents flat contact of surface 24 with the fabric, and acts as a comb to stir the pile concurrently with the initial contact of the steam with the fabric.

Among the refinements which can be added to nozzles according to the invention is modification to make steam dispensing more uniform all across the nozzle: by making the slot 26 narrower at this point and broadening it toward the ends of the nozzle, more uniform steam dispensing is accomplished.

The nozzle of FIG. 1 is preferably formed of sheet metal. FIGS. 6 and 7 show that a conventional cast aluminum nozzle 50 may be modified to enable practice of the invention. The surface 51 of the nozzle normally engaging the surface is inwardly curved at 52, and has a row of apertures 53 through which steam is dispensed to the fabric from a handle 31. A lip or blade 54 is secured to body 53 as by fasteners 55, and projects below surface 51 to perform the combined functions described above when the nozzle is moved back and forth across the surface.

Uniform steam displacement can be obtained in this embodiment of the invention by varying the size of the apertures 53 so that they become smaller as the center of the nozzle is approached.

It is convenient to have body 20 configured so that when the nozzle is suspended any condensation in the body runs to tap 23 and then back to the steam generator. The angularity needed in body 20 for this purpose is so slight as not to be perceptible in FIG. 1.

It is also sometimes convenient to be able to restrict the width of the steam outlet passage. To this end, as shown in FIG. 8, a shutter **24*a* may be adjustably secured to the lower surface 24 of body 20 by fasteners 26 passing through slots 26*a*** in the shutter to enable sliding of the shutter to a position in which it closes the steam outlet passage to a desired extent.

From the foregoing it will be evident that the invention comprises a method and apparatus for restoring the pile of carpeting and similar fabrics by treatment with low pressure steam concurrent with combing the materials to physically act on the pile fibers as the steam is applied.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. A carpet steaming tool comprising an elongated steam plenum having a generally flat outer surface, means for admitting steam to said plenum, dispensing means positioned along said surface for directing steam from said plenum outwardly from said tool, and a pile scraping blade member extending along said tool and projecting transversely beyond said surface.

2. A tool according to claim 1 in which said dispensing means comprises a plurality of apertures passing through said surface at sites spaced from the edge thereof and from said pile scraping blade member.

3. A tool according to claim 2 in which said surface includes a longitudinal groove aligned with and spaced from said blade member, and said apertures open externally through said groove.

4. A tool according to claim 1 in which said dispensing means comprises a longitudinal slot through said surface extending along said tool in alignment with and adjacent to said pile scraping blade member.

5. A tool according to claim 4 in which the steam admitting means is substantially central of the length of said tool, and said slot is narrow proximate said steam admitting means and broadens therebeyond along the tool in both directions.

6. A tool according to claim 1 in which said pile scraping blade member projects beyond said surface to a distance comparable to the height of the pile of a carpet.

7. A tool according to claim 1 in which the edge of said pile scraping blade member is straight.

* * * * *